US006359526B1

(12) United States Patent
Ohira et al.

(10) Patent No.: US 6,359,526 B1
(45) Date of Patent: Mar. 19, 2002

(54) NONRECIPROCAL CIRCUIT DEVICE INCLUDING DIELECTRIC WAVE GUIDE AND A LOWER DIELECTRIC CONSTANT MEDIUM

(75) Inventors: Katsuyuki Ohira, Otsu; Hiromu Tokudera; Yutaka Ishiura, both of Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/371,365

(22) Filed: Aug. 10, 1999

(30) Foreign Application Priority Data

Aug. 10, 1998 (JP) ..... 10-225670

(51) Int. Cl.[7] ..... H01P 1/36; H01P 1/38
(52) U.S. Cl. ..... 333/1.1; 333/24.2
(58) Field of Search ..... 333/1.1, 24.2

(56) References Cited

U.S. PATENT DOCUMENTS

| | | | | |
|---|---|---|---|---|
| 4,415,871 A | * | 11/1983 | Stern et al. | 333/1.1 |
| 4,446,448 A | * | 5/1984 | Stern | 333/1.1 |
| 5,666,094 A | | 9/1997 | Kato et al. | 333/1.1 |
| 5,781,086 A | * | 7/1998 | Kato et al. | 333/1.1 |

FOREIGN PATENT DOCUMENTS

| | | |
|---|---|---|
| EP | 0700113 | 3/1996 |
| EP | 0709912 | 5/1996 |
| EP | 0818844 | 1/1998 |
| JP | 9-186507 | 7/1997 |

OTHER PUBLICATIONS

Search Report date Jun. 27, 2001 of EP 99114855.

* cited by examiner

*Primary Examiner*—Justin P. Bettendorf
(74) *Attorney, Agent, or Firm*—Ostrolenk, Faber, Gerb & Soffen, LLP

(57) ABSTRACT

A nonreciprocal circuit device comprises a dielectric wave guide comprising a dielectric body with a center and with strips extending radially from the center in at least two directions and arranged between two conductor plates defining parallel conductor planes; a ferrite body arranged in the center of the dielectric strip; and a medium having a lower dielectric constant than the dielectric body arranged between at least a side face of the ferrite body and the conductor plates adjacent to the side face of the ferrite body. Grooves into which a dielectric strip is fitted are formed in the opposing surfaces of two conductor plates. The width of the dielectric strip is increased in the center of the dielectric strip and in the direction along the conductor planes of the conductor plates. At the widened location, a space is formed between the side walls of the grooves and the side faces of the ferrite sheets.

12 Claims, 11 Drawing Sheets

NONRECIPROCAL CIRCUIT DEVICE INCLUDING DIELECTRIC WAVE GUIDE AND A LOWER DIELECTRIC CONSTANT MEDIUM

BACKGROUND OF THE INVENTION

1. Field of the Invention

The present invention relates to a nonreciprocal circuit device including a dielectric wave guide, and a radio device including the nonreciprocal circuit device.

2. Description of the Related Art

A conventional circulator including a nonradiative dielectric wave guide (hereinafter, referred to as an NRD guide) is described in Electronic Data Communications Academy Bulletin EMCJ92-54, MW92-94 (1992-10), "60 GHz Band NRD Guide Gunn Oscillator," and Electronic Data Communications Academy Research Papers C-I, Vol. J77-C-I, No. 11, pp. 592–598, November 1994, "60 GHz Band FM Gunn Oscillator using an NRD Guide".

FIG. 13 shows the structure of the conventional circulator containing the above NRD guide. In FIG. 13, three dielectric strips 3, 4, and 5 are disposed between conductor plates 1 and 2 to form the NRD guide. Ferrite sheets 6 and 7 are arranged at the portion where the three dielectric strips are butted together. Magnets 8 and 9 are placed on the outer sides of the conductor plates 1 and 2 in such a manner as to sandwich the ferrite sheets 6 and 7.

A ferrite resonator comprising the ferrite sheets 6 and 7 is excited by an electromagnetic wave which is transmitted through the dielectric strips. A DC magnetic field is applied vertically to the surfaces of the ferrite sheets 6 and 7. In this case, due to the ferromagnetic characteristics of the ferrite sheets, the permeability of the ferrite sheets differs depending on the rotation direction of the high frequency magnetic field. As a result the polarized wave faces rotate, functioning as a circulator.

In a nonreciprocal circuit device including a dielectric wave guide such as the above-described circulator, the dielectric strips are arranged to extend radially from the center of the circulator. Therefore, dielectric strips of another circuit unit can seldom be linearly connected to the dielectric strips. To form a circuit with the dielectric wave guides, bending of the dielectric strips at some points is indispensable. However, in a bent portion of the dielectric strip, an LSM01 mode, which is the main transmission mode, becomes asymmetric with respect to the lateral direction. Thus, the conversion of the LSM01 mode to an LSE01 mode occurs. Accordingly, although it has been considered to design the bent portion so that all the electric power is completely converted to the LSM01 mode at the terminal of the bent portion, there is the problem that the bent portion cannot be formed to have a desired bending angle and radius of curvature.

Accordingly, the applicant of the present invention filed Japanese Patent Application No. 7-257803 in which an NRD guide (hereinafter, referred to as a hyper NRD guide) is described in which a groove into which a dielectric strip is to be fitted is formed on a conductor plate so that the cut-off frequency of the LSM01 mode is lower than that of the LSE01 mode in the propagation range of the dielectric wave guide; and in the non-propagation range, the space between the conductor planes of the conductor plates is made narrow so that the propagation can be carried out exclusively in the LSM01 mode.

The structure of the hyper NRD guide applied to the circulator is shown in FIG. 11, for example. The conductor plates 1 and 2 have grooves 21 and 22 respectively formed on the opposing surfaces thereof. The conductor plates 1 and 2 are so assembled that the dielectric strips 3, 4, and 5 and the ferrite sheets 6 and 7 fit into the grooves. The ferrite sheets 6 and 7 function as a ferrite resonator, couple a signal propagated in the LSM01 mode along one of the dielectric strips, and simultaneously rotate the polarized wave faces to propagate the signal in the LSM01 mode to another dielectric strip. With the above-described structure of the circulator including the hyper NRD guide, no mode-conversion to the LSE01 mode occurs, and thereby, the loss caused by the mode conversion can be reduced.

FIG. 12 is an upper plan view of the ferrite sheets 6 and 7 and the dielectric strips 3, 4, and 5 which are fitted into the groove 22 of the conductor plate 2 shown in FIG. 11. In the above-described structure in which the grooves 21 and 22 are respectively formed on the conductor plates 1 and 2 and the dielectric strips 3, 4 and 5 and the ferrite sheets 6 and 7 are fitted into the grooves 21 and 22, an electromagnetic field is disturbed on the periphery of the ferrite sheets 6 and 7 if the side walls of the grooves 21 and 22 of the respective conductor plates 1 and 2 are disposed very close to the side faces of the ferrite sheets 6 and 7. As a result, in the ferrite resonator, the ferrite sheets 6 and 7 and the dielectric wave guides 3, 4 and 5 are not matched. For this reason, the thicknesses (shown by the arrows in FIG. 12) of the dielectric portions parallel to the tangential directions of the ferrite sheets 6 and 7 are increased, and thereby, the distances between the side faces of the ferrite sheets 6 and 7 and the side walls of the grooves on the respective conductor plates 1 and 2 are undesirably widened.

However, with the above-described structure, an electromagnetic wave is propagated through the dielectric portions on the periphery of the ferrite sheets 6 and 7, so that the magnetic field coupling of the ferrite sheets 6 and 7 is weakened. As a result, in the case of the circulator having three ports, as shown in FIG. 12, for example, not only is an electromagnetic wave propagated from one of the ports to one of the other two ports, but also the electromagnetic wave is leaked to the remaining port. That is, the characteristics of the circulator as a nonreciprocal circuit device deteriorate.

The foregoing problem is caused not only in the case of the hyper NDR guide but also in a device in which grooves are formed in conductor plates and dielectric strips are arranged in the grooves.

SUMMARY OF THE INVENTION

Accordingly, the present invention provides a nonreciprocal circuit device including a dielectric wave guide device which has a structure in which a dielectric strip is fitted into grooves formed on conductor plates, and in which the nonreciprocal characteristics of the devices are prevented from deteriorating. The invention further provides a radio device including the nonreciprocal circuit device.

According to the present invention, there is provided a nonreciprocal circuit device which comprises a dielectric strip extending radially from the center in at least two directions, arranged between two conductor plates constituting parallel conductor planes, and a ferrite sheet arranged in the center of the dielectric strip. A substance having a lower dielectric constant than the dielectric strip is arranged between at least a side face of the ferrite sheet and the conductor plates adjacent to the side face of the ferrite sheet. Accordingly, matching of the resonance mode of the ferrite sheet and the mode of the dielectric wave guide can be easily achieved, and also, since the dielectric constant on the periphery of the ferrite sheet is reduced, the magnetic field coupling to the ferrite is not reduced, giving excellent nonreciprocal characteristics.

In order to provide the substance having a low dielectric constant, concave portions are formed in the centers of the conductor plates, and the substance having a lower dielectric constant than the dielectric strip (for example, an air space) is arranged at the periphery of the ferrite sheet. Further, on the conductor plates, are formed the grooves into which the dielectric strip is inserted to a predetermined depth, the width of the dielectric strip is increased in the centers of the conductor plates and in the direction along the parallel conductor planes of the conductor plates, and the substance having a low dielectric constant (for example, an air space) is arranged at the widened location and between the side walls of the grooves and the side face of the ferrite sheet.

Further, according to the present invention, there is provided a radio device which includes the nonreciprocal circuit device as a circulator containing the dielectric wave guide formed of the dielectric strip whereby a transmitting signal and a receiving signal are branched by means of the circulator.

Preferably, the radio device includes an isolator comprising the nonreciprocal circuit device in which a predetermined dielectric wave guide is provided with a terminator, whereby the reverse propagation of a signal is stopped by means of the isolator.

Other features and advantages of the invention will be understood from the following detailed description of embodiments thereof, with reference to the drawings.

DESCRIPTION OF EMBODIMENTS OF THE INVENTION

The structure of a circulator according to a first embodiment of the present invention will be now described with reference to FIGS. 1 through 4.

Figure 1:
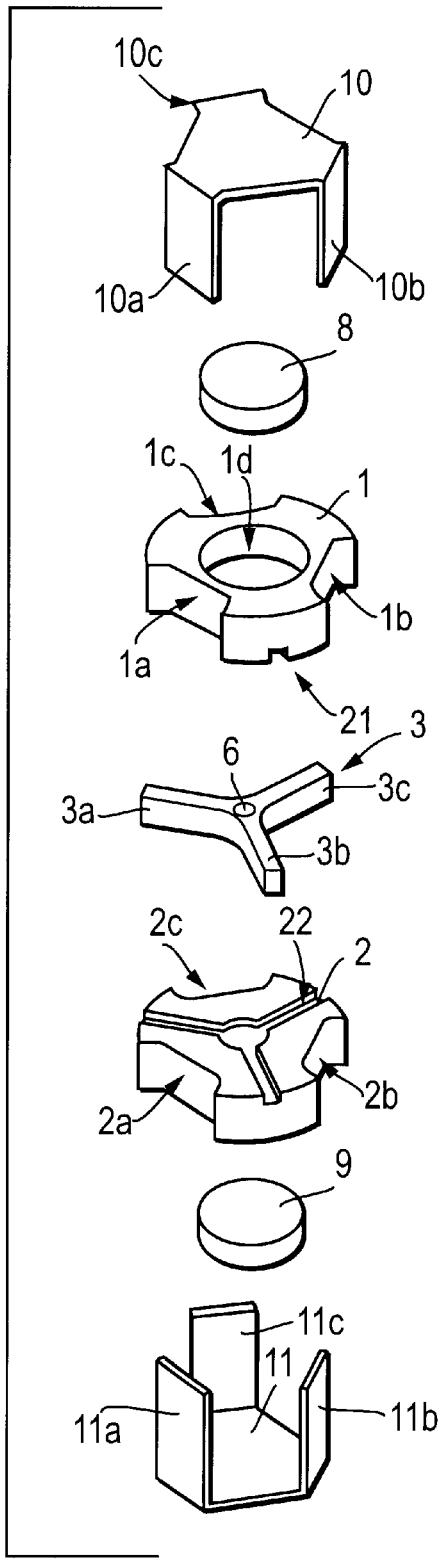
FIG. 1 is an exploded perspective view of a circulator.

FIG. 1 is an exploded perspective view of the circulator. Opposing surfaces of conductor plates 1 and 2 shown in FIG. 1 constitute conductor planes substantially parallel to each other. Grooves 21 and 22 are formed on the opposing surfaces of the two conductor plates 1 and 2, respectively. In a dielectric strip 3, three dielectric strip portions 3*a*, 3*b*, and 3*c* are integrally formed and extend radially at angular intervals of 120°.

Figure 3:
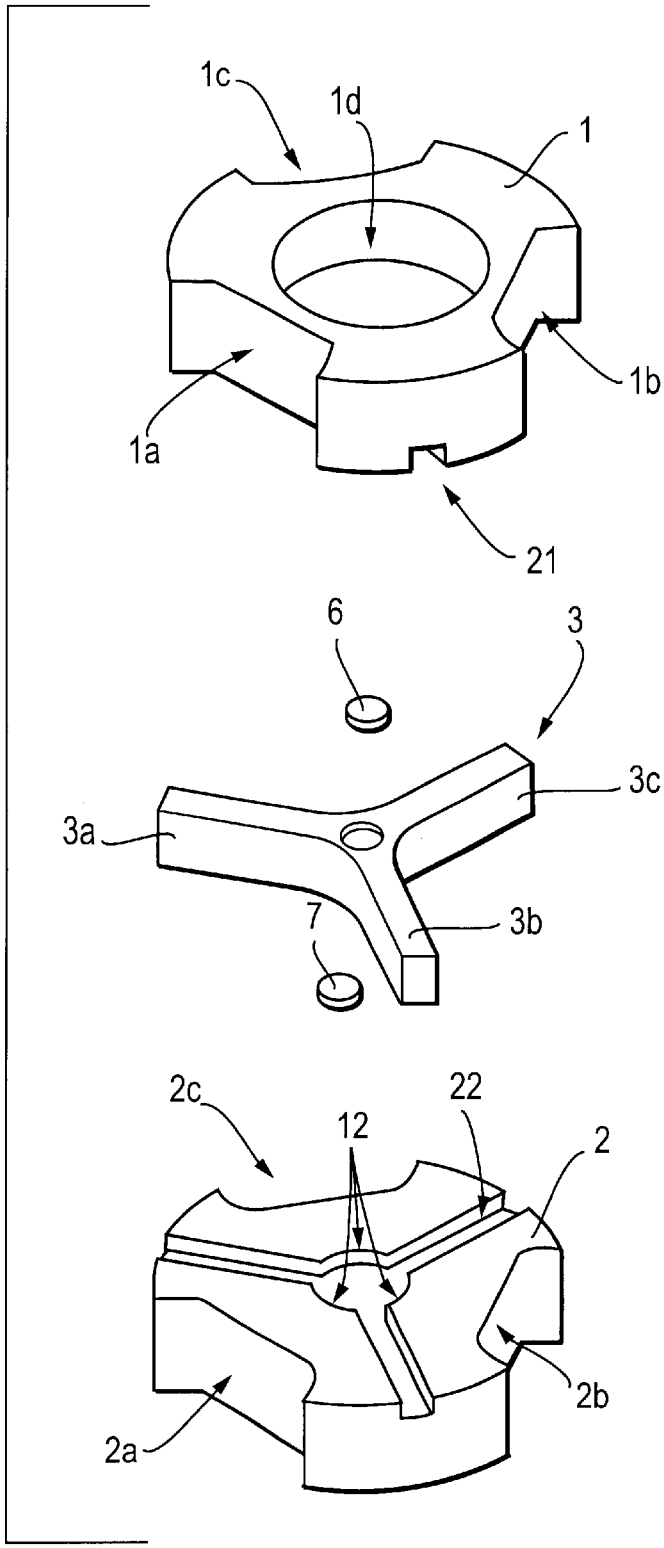
FIG. 3 is an enlarged perspective view of part of the circulator.

FIG. 3 is an exploded perspective view of the conductor plates 1 and 2, and the members to be sandwiched between the conductor plates 1 and 2. Concave portions are formed on the upper and lower surfaces in the center of the dielectric strip 3. Ferrite sheets 6 and 7 are fitted into the concave portions, and are sandwiched between the conductor plates 1 and 2 positioned at the upper and lower sides, respectively, and thereby, three hyper NRD guides, through which signals are propagated in the LSM01 mode, and a ferrite resonator resonating in the HE mode, are formed.

As shown in FIG. 1, concave portions for accommodating columnar-shaped magnets 8 and 9 are formed on the outer surfaces of the conductor plates 1 and 2. The concave portion 1*d* is formed on the upper conductor plate 1. Magnetic members 10 and 11 have side walls 10*a*, 10*b*, and 10*c*, and 11*a*, 11*b*, and 11*c*, respectively.

For the assembly of these parts, the dielectric strip 3 and the ferrite sheets 6 and 7 are sandwiched between the conductor plates 1 and 2, respectively. The magnets 8 and 9 are received in the concave portions of the conductor plates 1 and 2. Further, they are sandwiched between the magnetic members 10 and 11 placed from the outside, respectively, so that these parts are integrated.

Notches 1*a*, 1*b*, and 1*c*, and 2*a*, 2*b*, and 2*c* are provided in the conductor plates 1 and 2, respectively, at angles of 120°, each notch being disposed between a respective pair of the dielectric strips 3*a*, 3*b* and 3*c*. The side walls of the magnetic members 10 and 11 engage with the corresponding notches.

Figure 2A:
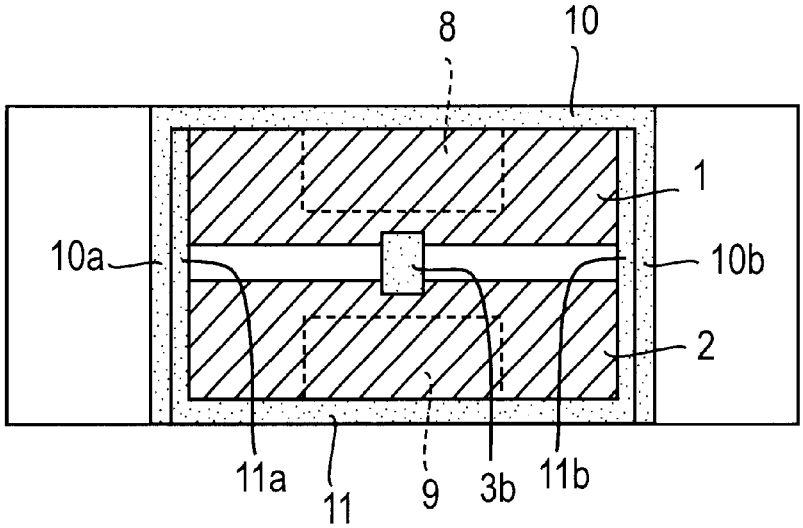
FIGS. 2A and 2B are a cross sectional view and a plan view of the circulator, respectively.
Figure 2B:
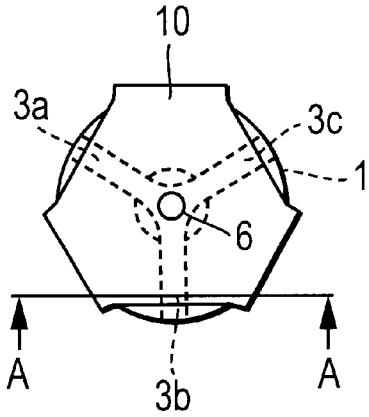

FIGS. 2A and 2B show illustrations of the assembled circulator of FIG. 1. FIG. 2B is an upper plan view of the circulator, and FIG. 2A is a cross-sectional view taken along the line A—A of FIG. 2B. The opposing surfaces of the upper and lower conductor plates 1 and 2, respectively, define the conductor planes. The conductor planes and the dielectric strips arranged therebetween form the hyper NRD guide. In this case, the space between the opposing surfaces of the conductor plates 1 and 2 is set to be narrower than $\lambda/2$, where $\lambda$ represents the wavelength of a millimeter wave which is an electromagnetic wave to be transmitted, and thereby, in the portions of the conductor planes where there are no dielectric strips, the propagation of the electromagnetic wave having a polarized wave face parallel to the conductor planes is blocked. Further, the space between the opposing surfaces of the conductor plates 1 and 2 and the height of the dielectric strip 3 are so set that the cut-off frequency in the LSM01 mode is lower than that in the LSE01 mode.

Figure 4:
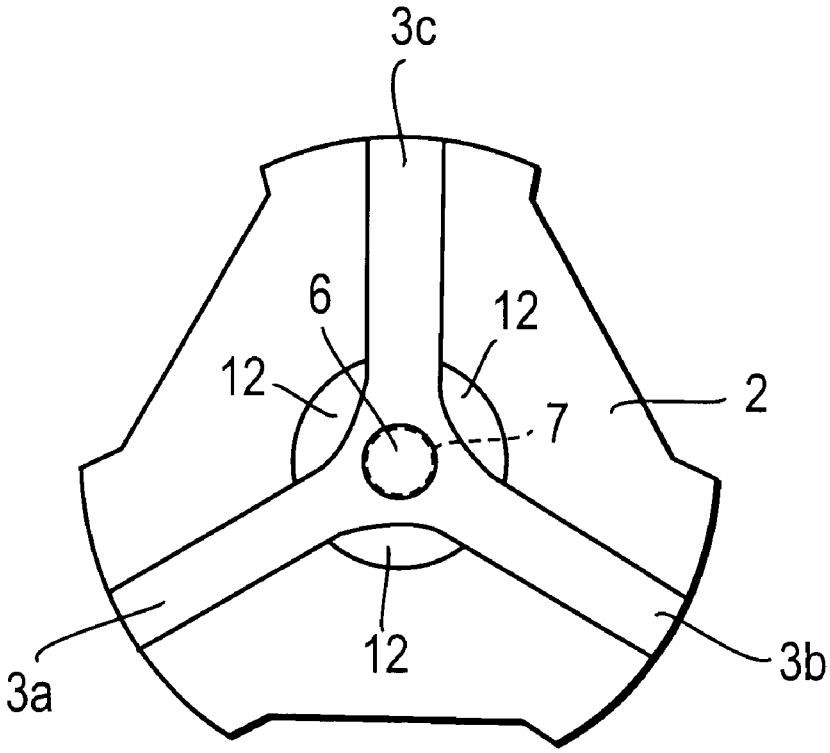
FIG. 4 is an upper plan view showing the relationship between a conductor plate, a dielectric strip, and a ferrite sheet.

FIG. 4 is an upper plan view of the circulator when the upper conductor plate 1 is removed. The width of the groove 22 provided for the conductor plate 2 is substantially equal to the width of the dielectric strips portions 3*a*, 3*b*, and 3*c*. In the center of the conductor plate 2, spaces 12, which serve as a medium having a lower dielectric constant than the dielectric strip 3, are formed between the side walls of the groove 22 and the side-face of the dielectric strip 3. With this structure, the space between the ferrite sheet and the conductor plate can be kept wide while the width of the dielectric strip at the periphery of the ferrite sheet is not considerably increased. Thus, the matching between the resonance mode of the ferrite sheet and the mode of the dielectric wave guide can be easily achieved, and moreover, since the dielectric constant at the periphery of the ferrite sheet is reduced, excellent nonreciprocal characteristics can be attained without weakening the magnetic field coupling to the ferrite sheet.

Figure 5:
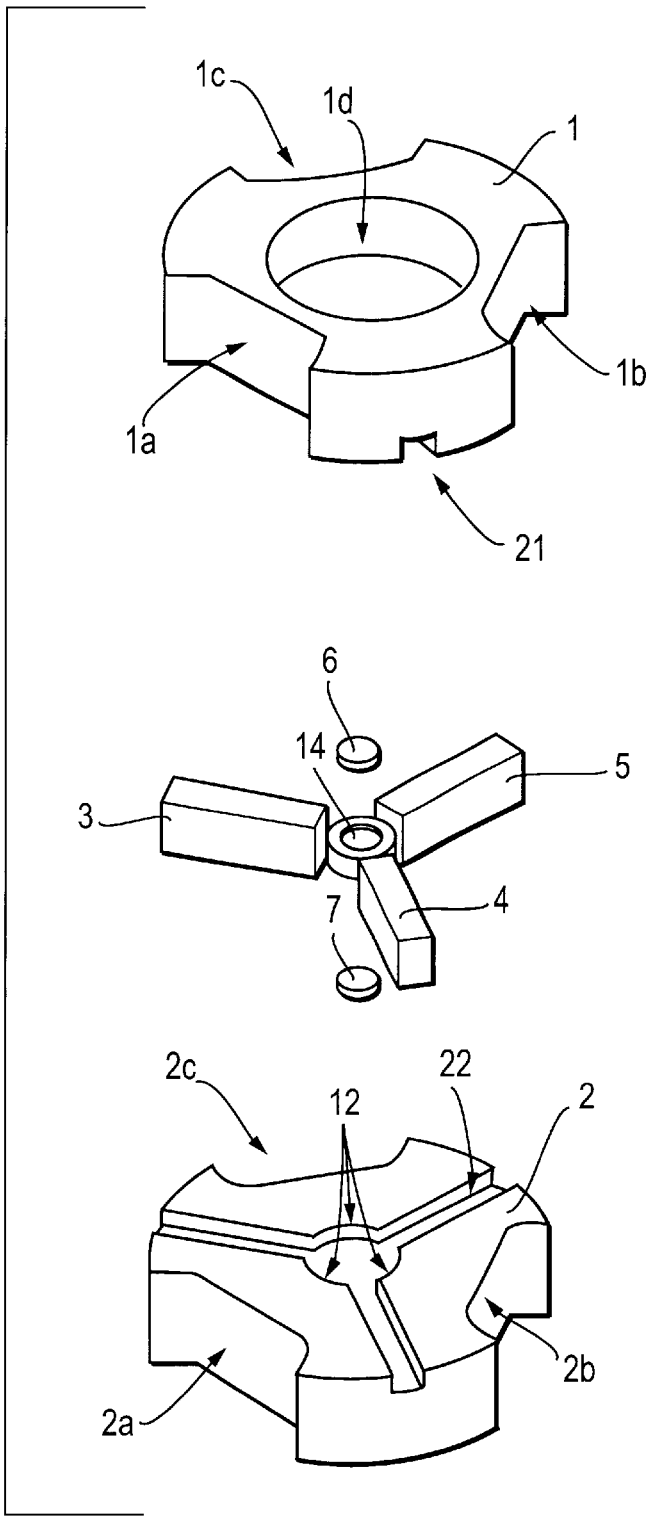
FIG. 5 is an exploded perspective view showing the structure of the major portion of another circulator.

FIG. 5 shows the structure of a circulator according to a second embodiment of the present invention. The dielectric strip described in the first embodiment has an integrated three-pronged shape. In the embodiment shown in FIG. 5, three independent, separate dielectric strips 3, 4, and 5 are employed, arranged to extend radially from the center in three directions at angular intervals of 120°. In order to hold the ferrite sheets 6 and 7 in the center of the conductor plate, a dielectric spacer 14 is used, and on the upper and lower sides of the spacer 14, the ferrite sheets 6 and 7 are fixed, respectively. Also in this case, spaces are provided between the side walls of grooves of the conductor plates 1 and 2 and the side faces of the dielectric spacer 14, respectively. Spaces 12 are formed on the conductor plate 2, and similar spaces are also formed on the conductor plate 1.

Figure 6A:
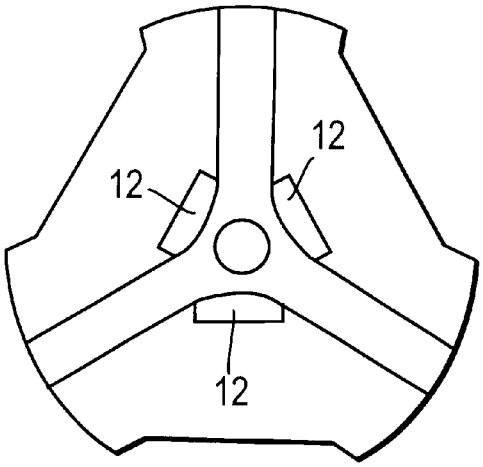
FIGS. 6A, 6B and 6C are upper side views of other circulators when the upper conductor plate is removed.
Figure 6B:
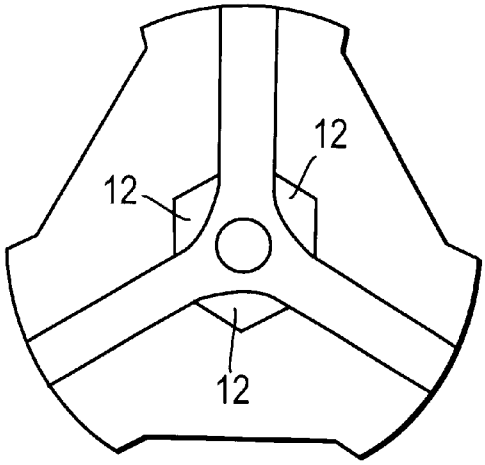
Figure 6C:
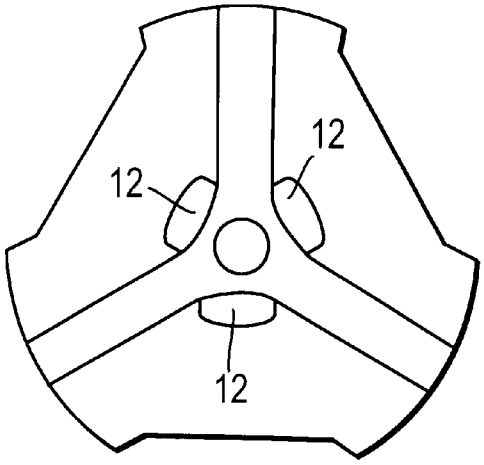

FIGS. 6A to 6C show illustrations of other possible shapes of the spaces 12. In the example of FIG. 6A, the spaces form substantially rectangular shapes in plan view. In the example of FIG. 6B, the spaces form triangular shapes. Further, in the example of FIG. 6C, the spaces form shapes defined by the combination of curved and straight lines. In addition, other shapes of the space can be used. In any case, a distance between the periphery of the ferrite sheets 6 and 7 and the conductor plates is ensured, and moreover, the propagation of an electromagnetic wave at the periphery of the ferrite sheets 6 and 7 can be inhibited. Therefore, excellent nonreciprocal circuit characteristics can be attained.

Figure 7A:
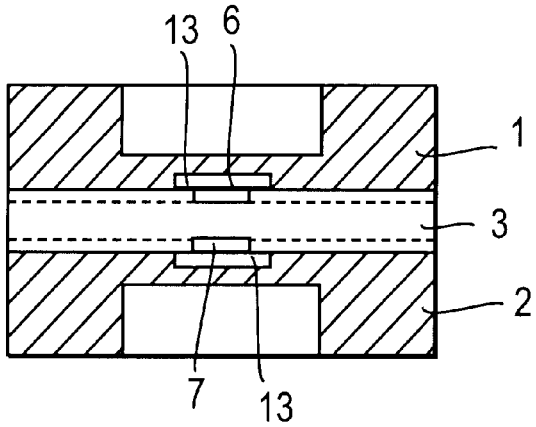
FIGS. 7A and 7B are a cross-sectional view and a plan view of yet another circulator.
Figure 7B:
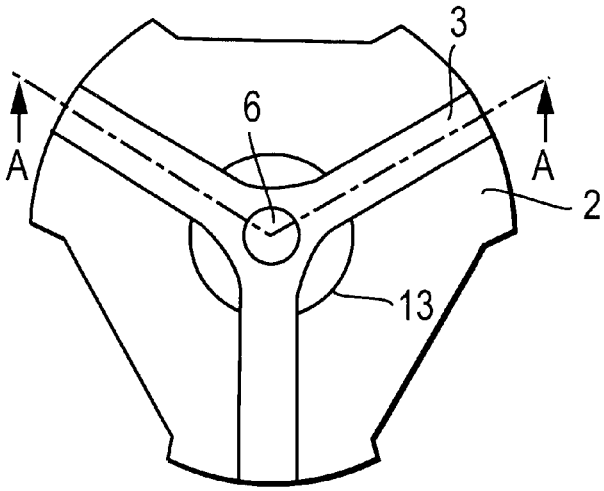

FIGS. 7A and 7B show illustrations of the structure of a circulator according to another embodiment of the present invention. FIG. 7B is an upper plan view of the circulator when the upper conductor plate is removed. FIG. 7A is a cross-sectional view taken along the line A—A of FIG. 7B. In this embodiment, concave portions 13 are formed in the centers of the conductor plates 1 and 2, that is, a space is formed both at the periphery of each of the ferrite sheets 6 and 7, and above or below an end face of each of the ferrite sheets 6 and 7. With the above structure, not only can the distances between the side faces of the ferrite sheets 6 and 7 and the conductor plates be ensured, but also those between the upper and lower sides of the ferrite sheets 6 and 7 and the conductor plates. Accordingly, the matching of the mode of the ferrite resonator formed of the ferrite sheets with the LSM01 mode of the dielectric wave guide can be easily attained.

Figure 8A:
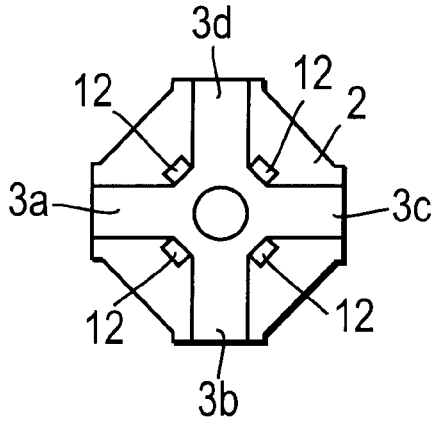
FIGS. 8A and 8B are illustrations showing an example of a four port dielectric wave guide nonreciprocal circuit device.
Figure 8B:
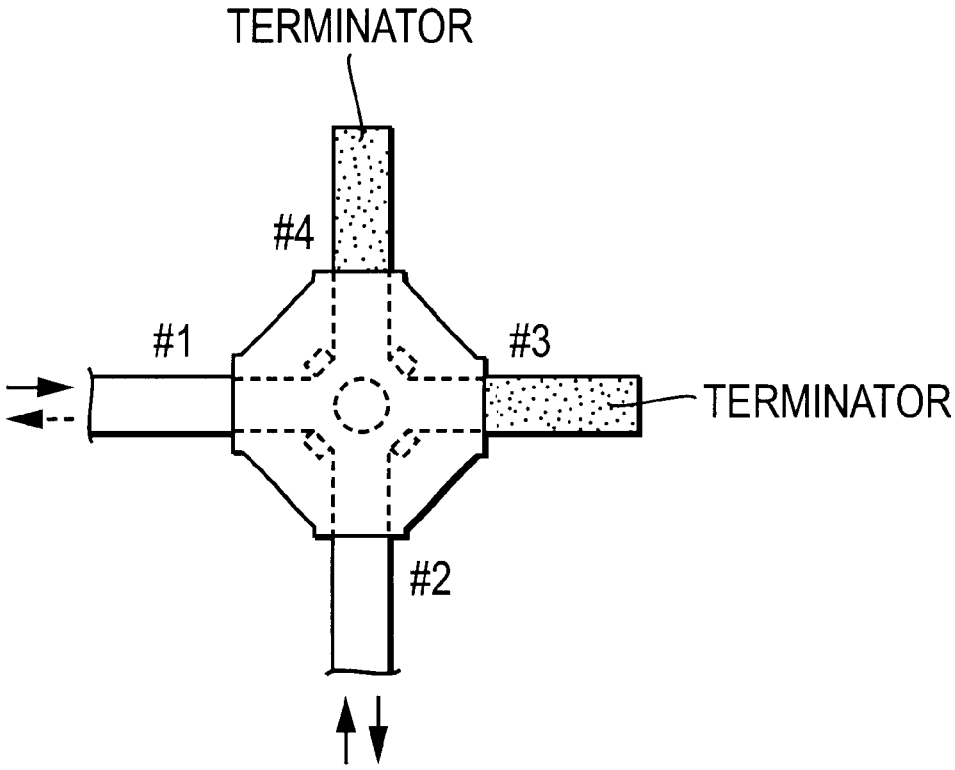

In each of the above embodiments, a three-port circulator is described as an example. However, as shown in FIGS. 8A and 8B, a four-port nonreciprocal circuit device including a dielectric wave guide may be formed. FIG. 8A is an upper plan view of the four-port nonreciprocal circuit device including a dielectric wave guide when the upper conductor plate is removed. FIG. 8B is an illustration of an isolator formed by using the circuit device. Thus, cross-shaped grooves and spaces 12 are formed in the conductor plate 2. The ferrite sheets are fixed to the upper and lower surfaces in the center of a cross-shaped dielectric strip composed of the dielectric strip portions 3*a*, 3*b*, 3*c*, and 3*d*. The dielectric strip is fitted into the groove of the conductor plate 2. The upper side of the conductor plate 2 having the dielectric strip fitted into the groove is covered with a conductor plate having the same shape and size as the conductor plate 2, whereby a four-port nonreciprocal circuit device including a dielectric wave guide is formed. An input signal from one of the dielectric wave guides, which extends radially from the center of the ferrite sheet, is output to the adjacent dielectric wave guide in the counterclockwise direction. That is, an input signal from one of the ports is output to the neighboring port on the right, the dielectric wave guide connects the port #1 and the port #2, and terminators are connected to each of the other two ports #3 and #4, as shown in FIG. 8B. Thus, the input signal from the port #1 is output through the port #2. A signal input from the port #2 is terminated with the terminator at the port #3. Accordingly, on the whole, the device acts as an isolator. The four-port nonreciprocal circuit device including a dielectric wave guide as described above, in which two of the dielectric strips are arranged in a perpendicular configuration, is advantageous in that the circuit configuration of the dielectric wave guide can be easily achieved.

Hereinafter, an example of the dielectric wave guide nonreciprocal circuit device applied to a millimeter wave radar module will be described with reference to FIGS. 9 and 10.

Figure 9:
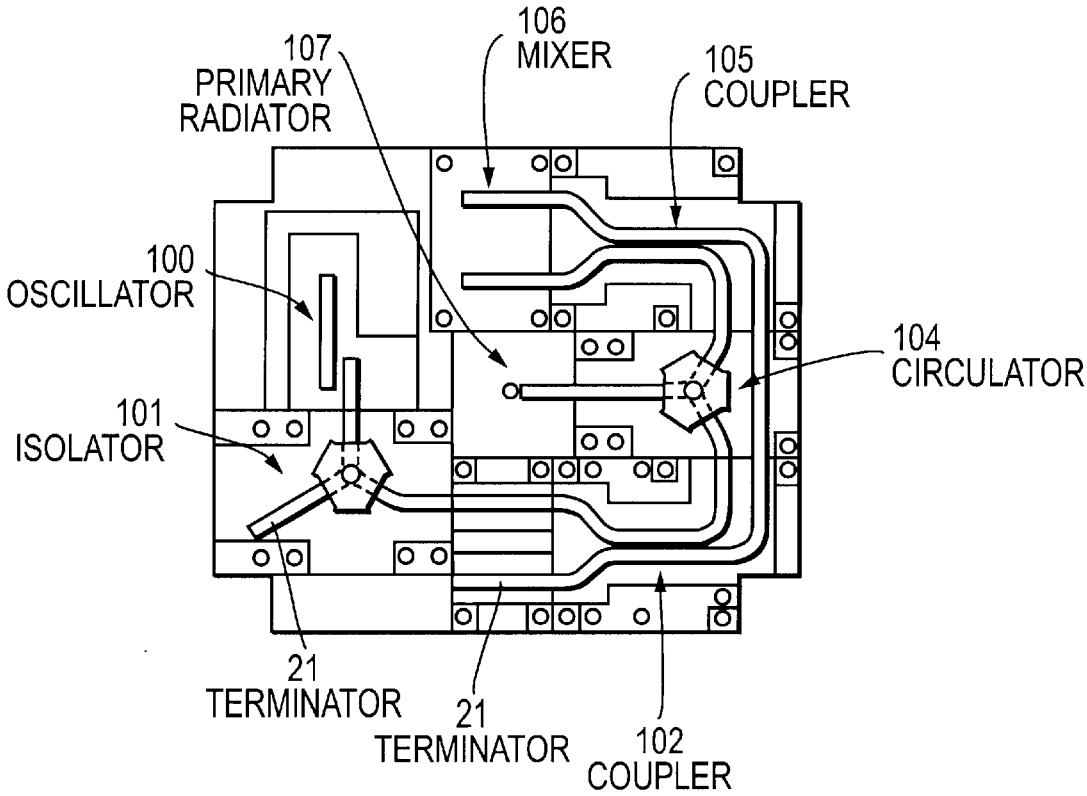
FIG. 9 is an illustration showing the structure of a millimeter wave radar module.
Figure 10:
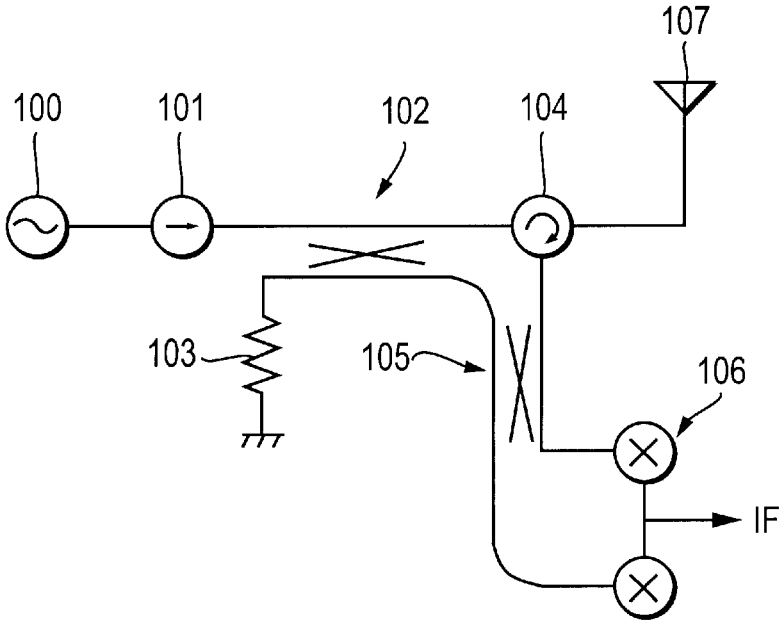
FIG. 10 is an equivalent circuit diagram of the millimeter wave radar module.
Figure 11:
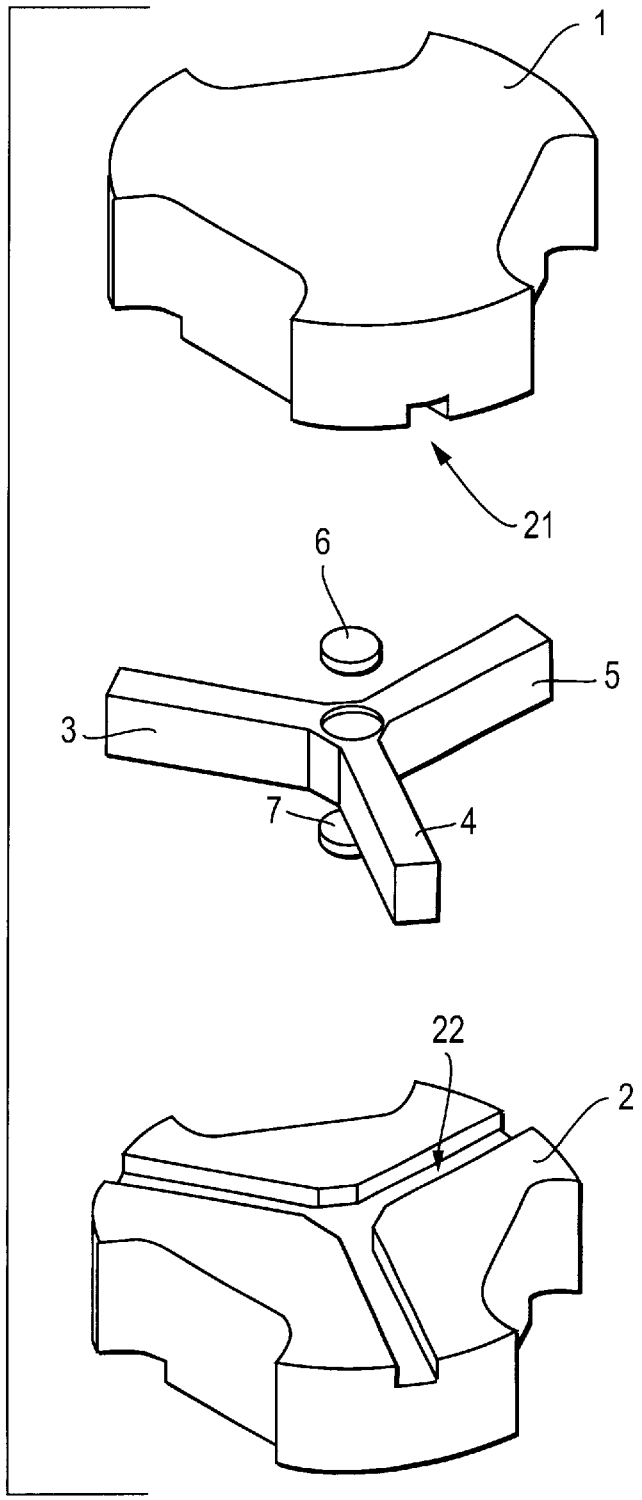
FIG. 11 PRIOR ART
FIG. 11 is an illustration showing an example of a conventional circulator.
Figure 12:
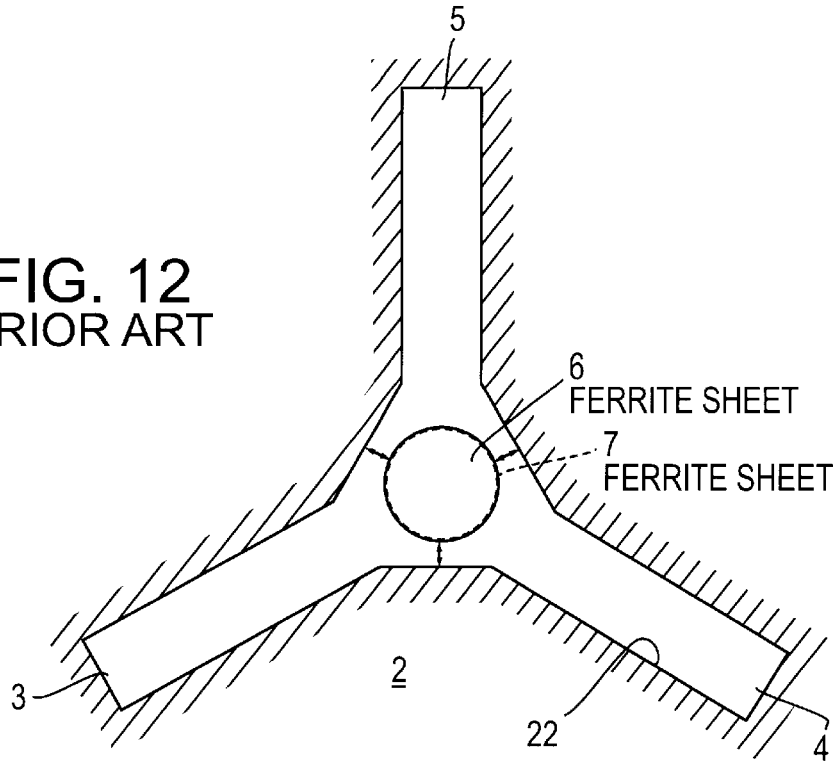
FIG. 12 PRIOR ART
FIG. 12 is an illustration of the relationship between the conductor plate, the dielectric strip, and the ferrite sheet of the conventional circulator.
Figure 13:
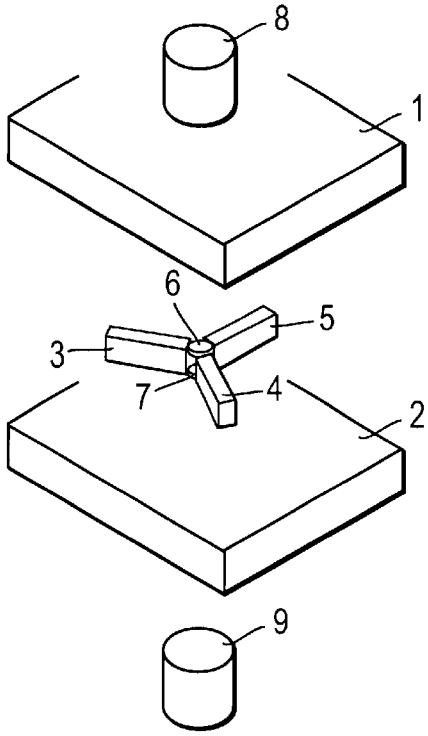
FIG. 13 PRIOR ART
FIG. 13 is an exploded perspective view showing the structure of another conventional circulator.

FIG. 9 is a plan view of the whole of the millimeter wave radar module when the upper conductor plate is removed. FIG. 10 is its equivalent circuit diagram. The module is mainly composed of an oscillator 100, an isolator 101, a coupler 102, a circulator 104, a coupler 105, a mixer 106, and a primary radiator 107. The respective units are connected through an NRD guide as a transmission line. The oscillator 100 is provided with a Gunn diode and a varactor diode, and outputs an oscillation signal to the input port of the isolator 101. The isolator 101 comprises a circulator, and a terminator 21 connected to the port of the circulator through which the reflected signal from the circulator is output. The circulator has a structure according to any one of the first through third embodiments. The coupler 102 including two dielectric strips disposed close to each other extracts the Lo (local) signal. The circulator 104 outputs a transmission signal to the primary radiator 107, and outputs a receiving signal from the primary radiator 107 to the coupler 105. The coupler 105 couples the receiving signal with the Lo signal to apply two signals to the mixer 106. The mixer 106 mixes the two signals by a balanced-type method to obtain an IF (intermediate frequency) signal.

The controller of the above-described millimeter wave radar module controls the oscillation frequency of the oscillator 100 by an FM-CW system, and also, signal-processes the IF signal to determine a distance to a detected object and a velocity relative to the detected object.

In the above-described embodiments, the space between the opposing surfaces of the conductor plates is set to be less than half the wavelength of the millimeter wave, and thereby, the propagation of an electromagnetic wave is cut off in the portions of the conductor plates where there are no dielectric strips. Further, the space between the opposing surfaces of the conductor plates and the size of the dielectric strip are so set that the cutoff frequency in the LSM01 mode is lower than that in the LSE01 mode. However, according to the present invention, the dielectric wave guide is not limited to the hyper NRD guide and the NRD guide.

In the above embodiments, as examples of the nonreciprocal circuit device, three and four port circulators are described. However, according to the present invention, the circulator is not limited to the three and four port circulators. In general, the present invention can be applied to a device in which ferromagnetic sheets are arranged substantially parallel to the conductor planes and adjacent to the planes of the dielectric strip substantially in contact with the conductor plane, so that the device has non-reciprocal circuit characteristics obtained by utilization of its tensor permeability.

Further, in the above embodiments, the ferrite sheets are arranged nearly in the upper and lower planes of the dielectric strip which are in contact with the upper and lower conductor sheets. However, the ferrite sheet may be arranged in only one of the planes of the dielectric strip. The ferrite sheet does not need to have a disk shape, and may have a polygonal shape, for example. Further, a columnar-shape ferrite may be used.

According to the present invention, the matching of the resonance mode of the ferrite with the mode of the dielectric wave guide can be easily achieved. In addition, since the dielectric constant at the periphery of the ferrite is reduced, the magnetic field coupling to the ferrite is prevented from weakening, and excellent nonreciprocal characteristics can be attained. Preferably, the branching of a transmitting signal and a receiving signal is carried out by means of the circulator containing the dielectric wave guide and having excellent nonreciprocal characteristics. Accordingly, a radio device such as a miniaturized millimeter wave radar containing the dielectric wave guide can be easily formed.

Also preferably, in the radio equipment, the reverse propagation of a signal is stopped by means of the isolator containing the dielectric wave guide and having excellent nonreciprocal circuit characteristics. Thus, in a circuit containing the dielectric wave guide as a propagation path, a return signal to an oscillator for example can be positively stopped. Radio equipment with excellent characteristics can be easily formed. Although embodiments of the invention have been described herein, the invention is not limited to such embodiments, but rather extends to all modifications and variations that may occur to one having ordinary skill in the art within the fair spirit and scope of the invention.

What is claimed is:

1. A nonreciprocal circuit device comprising:

a dielectric wave guide comprising a dielectric body with a center and with strips extending radially from the center and arranged between two conductor plates defining parallel conductor planes;

a ferrite body arranged at the center of the dielectric body, said ferrite body having a peripheral side face; and a medium having a lower dielectric constant than the dielectric body arranged between at least said side face of the ferrite body and the conductor plates adjacent to the side face of the ferrite body;

wherein recesses are disposed in the conductor plates, and said medium having a lower dielectric constant than the dielectric body is arranged in said recesses.

2. A nonreciprocal circuit device according to claim 1, wherein said recesses are further disposed between an end face of said ferrite body and the corresponding conductor plate adjacent thereto.

3. A nonreciprocal circuit device comprising:

a dielectric wave guide comprising a dielectric body with a center and with strips extending radially from the center and arranged between two conductor plates defining parallel conductor planes;

a ferrite body arranged at the center of the dielectric body, said ferrite body having a peripheral side face; and a medium having a lower dielectric constant than the dielectric body arranged between at least said side face of the ferrite body and the conductor plates adjacent to the side face of the ferrite body;

wherein each conductor plate is provided with a groove into which the strips of the dielectric body are inserted to a predetermined depth, the width of each dielectric strip in the center thereof is widened in the direction along the parallel conductor planes, and the medium having a lower dielectric constant is arranged between the widened location of each dielectric strip and the corresponding groove and between said corresponding groove and the side face of the ferrite body.

4. A nonreciprocal circuit device according to claim 3, wherein said medium is further arranged between an end face of said ferrite body and the corresponding conductor plate adjacent thereto.

5. A radio device including a reception circuit, a transmitting circuit, and a nonreciprocal circuit device comprising:

a dielectric wave guide comprising a dielectric body with a center and with strips extending radially from the center and arranged between two conductor plates defining parallel conductor planes;

a ferrite body arranged at the center of the dielectric strip, said ferrite body having a peripheral side face; and a medium having a lower dielectric constant than the dielectric body arranged between at least said side face of the ferrite body and the conductor plates adjacent to the side face of the ferrite body;

a first one of said strips being coupled to said transmitting circuit for receiving a transmitting signal;

a second one of said strips being coupled to a primary radiator for delivering said transmitting signal to said primary radiator and for receiving a reception signal from said primary radiator; and a third one of said strips being coupled to said reception circuit for delivering said reception signal to said reception circuit;

wherein recesses are disposed in the conductor plates, and said medium having a lower dielectric constant than the dielectric body is arranged in said recesses.

6. A radio device according to claim 5, wherein said recesses are further disposed between an end face of said ferrite body and the corresponding conductor plate adjacent thereto.

7. A radio device including a reception circuit, a transmitting circuit, and a nonreciprocal circuit device comprising:

a dielectric wave guide comprising a dielectric body with a center and with strips extending radially from the center and arranged between two conductor plates defining parallel conductor planes;

a ferrite body arranged at the center of the dielectric strip said ferrite body having a peripheral side face; and a medium having a lower dielectric constant than the dielectric body arranged between at least said side face of the ferrite body and the conductor plates adjacent to the side face of the ferrite body;

a first one of said strips being coupled to said transmitting circuit for receiving a transmitting signal;

a second one of said strips being coupled to a primary radiator for delivering said transmitting signal to said primary radiator and for receiving a reception signal from said primary radiator; and a third one of said strips being coupled to said reception circuit for delivering said reception signal to said reception circuit;

wherein each conductor plate is provided with a groove into which the strips of the dielectric body are inserted to a predetermined depth, the width of each dielectric strip in the center thereof is widened in the direction along the parallel conductor planes, and the medium having a lower dielectric constant is arranged between the widened location of each dielectric strip and the corresponding groove and between said corresponding groove and the side face of the ferrite body.

8. A radio device according to claim 7, wherein said medium is further arranged between an end face of said ferrite body and the corresponding conductor plate adjacent thereto.

9. A radio device including a reception circuit, a transmitting circuit, and an isolator comprising:

a dielectric wave guide comprising a dielectric body with a center and with strips extending radially from the center and arranged between two conductor plates defining parallel conductor planes;

a ferrite body arranged at the center of the dielectric strip, said ferrite body having a peripheral side face; and a medium having a lower dielectric constant than the dielectric body arranged between at least said side face of the ferrite body and the conductor plates adjacent to the side face of the ferrite body;

a first one of said strips being coupled to one of said reception and transmitting circuits for conveying a signal in a first direction with respect to said circuit;

a second one of said strips conveying said signal in said first direction toward the other of said reception and transmitting circuits;

a third one of said strips being coupled to a terminator, whereby the reverse propagation of a signal in a direction away from said other circuit is stopped by the isolator;

wherein recesses are disposed in the conductor plates, and said medium having a lower dielectric constant than the dielectric body is arranged in said recesses.

10. A radio device according to claim 9, wherein said recesses are further disposed between an end face of said ferrite body and the corresponding conductor plate adjacent thereto.

11. A radio device including a reception circuit, a transmitting circuit, and an isolator comprising:

a dielectric wave guide comprising a dielectric body with a center and with strips extending radially from the center and arranged between two conductor plates defining parallel conductor planes;

a ferrite body arranged at the center of the dielectric strip, said ferrite body having a peripheral side face; and a medium having a lower dielectric constant than the dielectric body arranged between at least said side face of the ferrite body and the conductor plates adjacent to the side face of the ferrite body:

a first one of said strips being coupled to one of said reception and transmitting circuits for conveying a signal in a first direction with respect to said circuit;

a second one of said strips conveying said signal in said first direction toward the other of said reception and transmitting circuits;

a third one of said strips being coupled to a terminator, whereby the reverse propagation of a signal in a direction away from said other circuit is stopped by the isolator;

wherein each conductor plate is provided with a groove into which the strips of the dielectric body are inserted to a predetermined depth, the width of each dielectric strip in the center thereof is widened in the direction along the parallel conductor planes, and the medium having a lower dielectric constant is arranged between the widened location of each dielectric strip and the corresponding groove and between said corresponding groove and the side face of the ferrite body.

12. A radio device according to claim 11, wherein said medium is further arranged between an end face of said ferrite body and the corresponding conductor plate adjacent thereto.

* * * * *